United States Patent [19]

Wray et al.

[11] 4,100,814

[45] Jul. 18, 1978

[54] SIX-BOX LINKAGE MECHANISM

[75] Inventors: Gordon Richard Wray, Loughborough; Ruth Mary Parry, Ringwood, both of England

[73] Assignee: National Research Development Corporation, London, England

[21] Appl. No.: 835,204

[22] Filed: Sep. 21, 1977

Related U.S. Application Data

[63] Continuation of Ser. No. 647,982, Jan. 8, 1976, abandoned.

[30] Foreign Application Priority Data

Jan. 10, 1975 [GB] United Kingdom ..... 01106/75

[51] Int. Cl.[2] ..... F16H 21/18

[52] U.S. Cl. ..... 74/43; 139/190

[58] Field of Search ..... 112/121.11, 121.12, 112/121.15; 74/568, 571, 43; 139/142, 144, 133, 134, 190

[56] References Cited

U.S. PATENT DOCUMENTS

| | | | |
|---|---|---|---|
| 3,964,523 | 6/1976 | Benedict | 74/43 |
| 3,964,524 | 6/1976 | Benedict | 74/43 |

FOREIGN PATENT DOCUMENTS

| | | | |
|---|---|---|---|
| 15,622 | 9/1928 | Australia | 74/43 |

OTHER PUBLICATIONS

Hinkle–Kinematics of Machines–1953, 1960, pp. 256–265.

*Primary Examiner*—Benjamin W. Wyche
*Assistant Examiner*—Wesley S. Ratliff, Jr.
*Attorney, Agent, or Firm*—Cushman, Darby & Cushman

[57] ABSTRACT

A mechanism is described for effecting movement of an object, article or device in a closed loop planar path while maintaining the major axis of the object, article or device in substantially fixed attitude in the execution of at least an appreciable portion of the path, the mechanism comprising a six-bar linkage the dimensions of which are derived from a four-bar linkage to ensure the fixed attitude motion during motion through at least the appreciable portion of the closed loop path. A method of designing such a linkage mechanism comprises selecting a set of a finite number of discrete points around an idealized version of the closed path, at which points precise positioning and/or movement of the object is required to take place, establishing the dimensions of a four-bar linkage which will generate a synthesized path passing through the said selected precision points and deviating from the idealized path, if at all, by only an acceptable amount, and deriving from this four-bar linkage the dimensions of a six-bar linkage which will cause the required fixed attitude motion in the synthesized path.

15 Claims, 14 Drawing Figures

SCALE: 1 UNIT = 2·54 mm

COGNATE SYSTEM FOR LINKAGE ANALYSIS

Fig. 6.
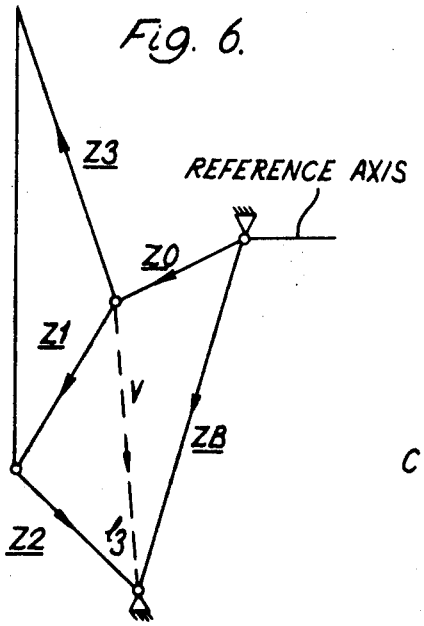
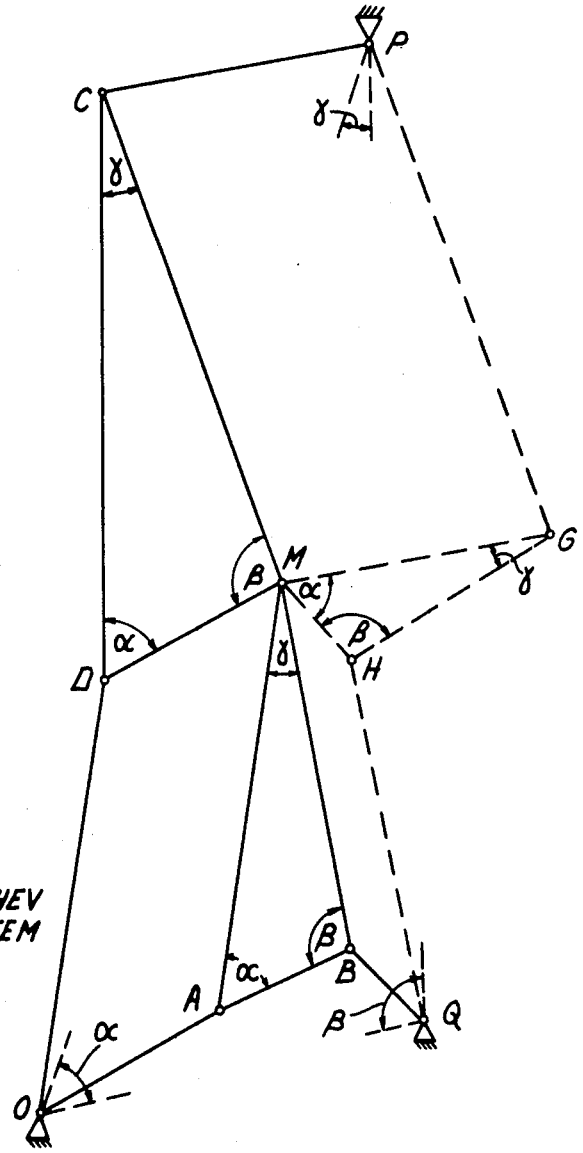
THE ROBERTS-CHEBYCHEV COGNATE LINKAGE SYSTEM
Fig. 7.

COMBINED COGNATE LINKAGES

DERIVED PARALLEL MOTION LINKAGES

SIX-BOX LINKAGE MECHANISM

This is a continuation of application Ser. No. 647,982 filed Jan. 8, 1976, now abandoned.

This invention relates to mechanisms for effecting orbital motion and more especially for producing movement of an object, article or device in a controlled attitude in a closed loop planar path.

Such mechanism is desirable, for example, for actuating a needle in a pile fabric producing machine, such as is disclosed in U.K. Patent Specification No. 1 268 201. In one type of such machine, two rows of sewing-type needles and associated loopers are arranged opposite each other to form pile loops on each side of a preformed base fabric. By causing the needles to move in particular planar orbits, loop insertion is effected while the fabric is moved continuously past an insertion region and pile fabric may be produced at very favourable rates using such machines. In order that the needles when inserted into the fabric should follow the forward feed movement of the fabric so as not to damage the fabric, that part at least of the orbital movement should be precisely produced each time and it is clear that the attitude of the needles needs to be preserved at least while they are inserted; control of the movement of the needles is, therefore, made more onerous. In one industrial application of this process, the movement is generated by cam mechanisms. As is well-known, however, mechanisms involving cams, particularly high speed mechanisms, besides requiring highly accurate finishing operations for the cam profiles, are prone to high wearing rates unless made from expensive materials. One of the objectives of the present invention was to provide an alternative mechanism for actuating the needles in such a machine.

The basis of the invention is a method of designing a linkage mechanism for effecting movement of an object, article or device in a closed loop planar path while maintaining the major axis of the object, article or device in substantially fixed attitude in the execution of at least an appreciable portion of the path. Thus, the method comprises selecting a set of a finite number of discrete precision points around an idealized version of the said closed loop path, establishing the dimensions of a four-bar linkage which will generate a synthesized path passing through the said precision points and deviating from said idealized path, if at all, by only an acceptable amount, and deriving from said four-bar linkage the dimensions of a six-bar linkage which will cause the required fixed attitude motion in the synthesized path.

According to a feature of the invention, means are provided for effecting movement of an object, article or device in a closed loop planar path while maintaining the object, article or device in substantially fixed attitude during execution of at least an appreciable portion of the path, said means comprising a six-bar linkage mechanism the dimensions of which are derived from a four-bar linkage to ensure said fixed attitude motion of the said object, article or device during said portion at least of the said path, said four-bar linkage being dimensioned to generate a path passing through at least selected precision points on an idealized version of said closed loop path. By 'precision point' is meant a point on the actual path where precise positioning and/or movement of the object is required to take place. It will be obvious, in any particular machine, where precise positioning and/or movement of the moving device is not essential and the design criteria become less onerous.

In order that the invention may be more clearly understood, the design criteria for determining a mechanism for effecting movement of the needles in a machine, such as referred to above, for producing a pile fabric, will now be described. It will be obvious, however, that similar criteria would apply in the case of a machine in which movement of, say, at least one sheet of planar material is effected in a given closed planar path while maintaining it in a fixed attitude so that any line drawn between two points at random on the surface of the sheet would be moved substantially parallel to itself.

FIG. 6 shows a vector diagram.

FIG. 7 shows the syntheized of linkage and the first and second cognat linkages.

Figure 1:
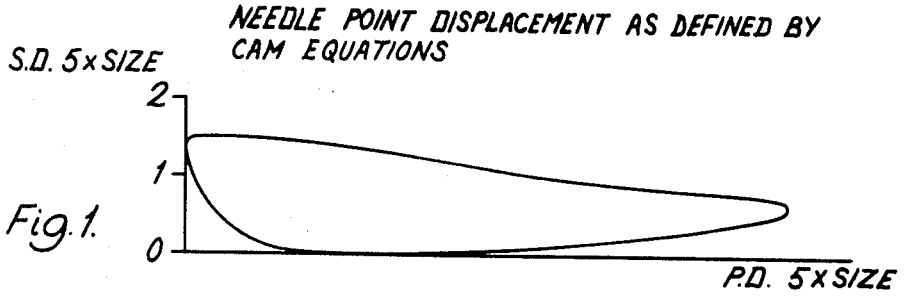
FIG. 1 shows the idealized path of the needle point.
Figure 2:
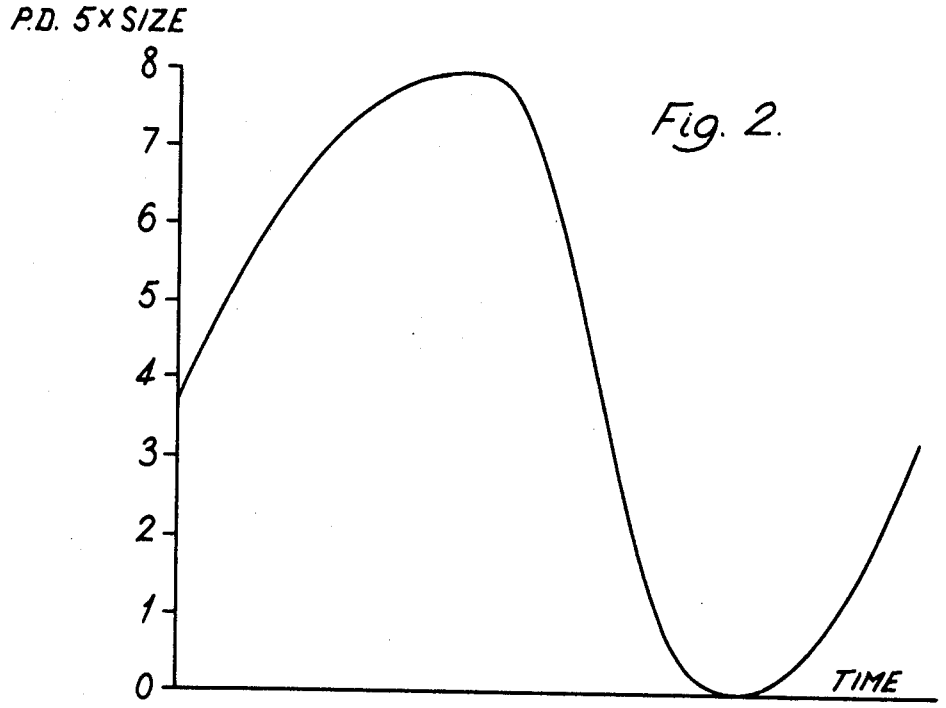
FIG. 2 shows one component of the needle motion.
Figure 3:
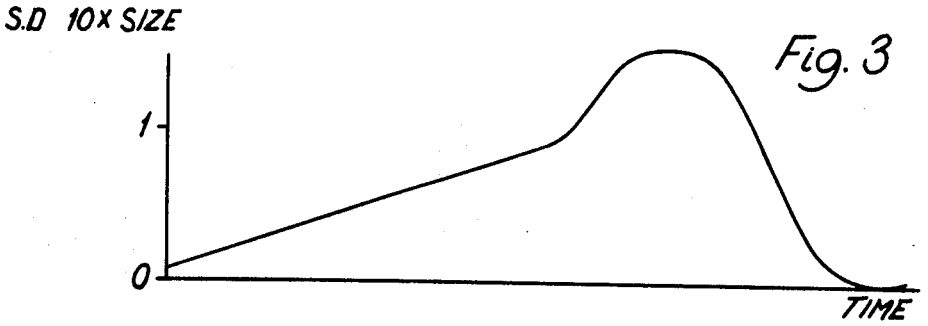
FIG. 3 shows another component of the needle motion.

In order to determine the effective linkage for the purpose intended, it is necessary, of course, first to ascertain the required path and to define an idealized version of that path. Thus the idealized path of the needle point is taken to be that shown in FIG. 1. However, an orbit defined by a number (5, up to say 16) of discrete positions may suffice. In the case of the path shown in FIG. 1, needle motion in this path can be split time-wise into two components representing, a shown in FIG. 2, (i) the primary displacement (P.D.) along the needle axis and as shown in FIG. 3, (ii) the secondary displacement (S.D.) perpendicular to the needle axis. The displacement scale in FIG. 3 is twice that of FIGS. 1 and 2. Each of these displacements may be represented by a suitable equation.

It will usually be necessary to take account of the geometry of the particular machine in which the linkage is to be used and also any specific features of performance of the machine which may govern the dimensions of the linkage. Thus in the case of the pile fabric machine it will be necessary to position the linkage to avoid interference with the loop forming mechanism and to avoid the condition where part of the mechanism might intersect the fabric plane. It will be desirable to take into consideration provision of the facility to enable the pile fabric to be inspected as it leaves the loop insertion zone. Also the final linkage design should preferably not involve linkage members so small as to present difficulties in manufacture of the linkage.

Having defined the idealized path or orbit which the linkage should cause the needle point to follow, it is necessary to select a method of synthesising a four-bar linkage system to move the needle over this path or over a path which is near enough theoretically to meet the other conditions of the needling process.

A number of methods are available from the literature on mechanisms and any so-called five-point precision synthesis method may be used. In accordance with a feature of the invention, the precision points are selected in such a way that the path of the resulting linkage will deviate from the idealized path by only an acceptable amount. This is achieved by successively relocating the precision points and evaluating the resulting linkages. A measure of the deviation of the generated path from the idealized path is the structural error of the linkage. Since it would not be possible to manufacture linkages to the accuracy to which they may be synthesised, the structural error is somewhat hypothetical but it is realistic that the accuracy should be such as enables the error to be found to a good accuracy.

Using the five-point precision synthesis method devised by D. Tesar and J. W. Sparks (The Generalised Concenpt of Five Multiple Separated Positions in Planar Motion, Jnl. Mechanisms, 3, 1968, pages 25 - 33) the synthesis is reduced to a system of four linear equations and two quadratic equations in six unknowns. The linear equations are solved using Gaussian reduction with pivotting (I.C.L. 1900 Series Scientific Subroutines, 1968, pages 181–2) which leads to a high degree of accuracy. The solutions to the linear equations are then substituted into the quadratic equations to obtain two simultaneous quadratic equations in two unknowns, $x$ and $y$, which are the co-ordinates of a circle point, that is to say a point on the locus of the pivot at the free end of a guiding link to which a coupler link, i.e. an intermediate link not connected to the reference plane, is pivoted, see FIG. 4.

Using the Newton-Raphson method for solving simultaneous nonlinear equations (F. B. Hildebrand, "Introduction to Numerical Analysis," McGraw-Hill, 1956 page 451) the quadratic equations are solved numerically with reasonably high accuracy. The co-ordinates $(a, b)$ of each centre point are found from the co-ordinates of the corresponding circle point by substitution in the other equations.

Each pair of circle points $(x_i, y_i)$, $i = 1,2$, with their corresponding points $(a_i, b_i)$, $i = 1,2$, defines the position of all the pivots of a linkage with its coupler point at the origin, which is one of the precision points.

There are two ways of assembling any four bar linkage which comprises (i) a base link, i.e. a link which is coincident with, and does not move relative to, the reference plane, (ii) a crank, i.e. a link connected to the reference plane and usually capable of continuous unimpeded rotation in the same sense, (iii) a coupler, as defined above, and (iv) a rocker, i.e. a link which is connected to the reference plane and which oscillates between two extreme positions when the linkage is driven. Such a linkage is termed a crank-and-rocker linkage. Each way of assembling the links gives a different coupler path and there is only one correct way of assembling them for each precision point. It may occur that the linkage has a coupler path which would not pass through all the precision points unless the links were to be disconnected and reassembled in the alternative way; such linkages are to be rejected.

Using the Roberts-Chebychev Theorem (See Roberts, S. "On Three Bar Motion in Plane Space", Proc. Lond. Math. Soc., 7, 1876, pp. 14 - 23) which states that the same path can be generated by three different four-bar linkages (these linkages being called 'path cognates'), and applying it to the synthesised linkage it is determined in which way each cognate linkage is correctly assembled.

To determine the structural error of the synthesised linkage, it is first necessary to find the co-ordinates of the coupler point corresponding to any given input angle, i.e. the angle through which the input link of the linkage is rotated.

Figure 5:
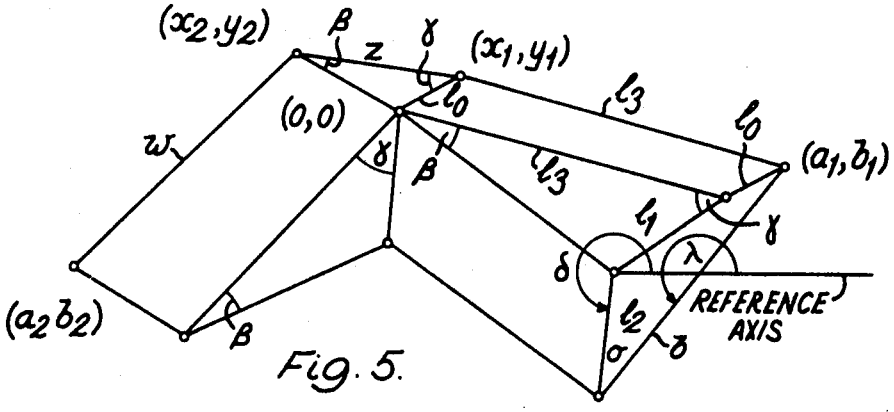
FIG. 5 shows the synthesized and cognate linkages.

Referring to FIG. 5 which shows the synthesised and cognate linkages in one system, the parameters are the lengths $l_o$, $l_1$, $l_2$, $l_3$ and $b$, the fixed angles $\gamma$ and $\lambda$ and a sign parameter, S, determined by the angle $\sigma$. If the latter angle, measured from the base link to the rocker link is positive i.e. anti-clockwise sense of rotation, the sign parameter is given the value, 1:0; if the angle is negative, the parameter S is given the value $-1.0$. In the system of FIG. 5, of course, S has the value of 1.0.

The link lengths are calculated as follows:

| | |
|---|---|
| $z = (x_2 - x_1)^2 + (y_2 - y_1)^2)^{\frac{1}{2}}$ | $v = ((a_1 - a_2)^2 + (b_1 - b_2)^2)^{\frac{1}{2}}$ |
| $l_0 = (x_1^2 + y_1^2)^{\frac{1}{2}}$ | $l_1 = l_3 \cdot l_0/z$ |
| $l_3 = ((x_1 - a_1)^2 + (y_1 - b_1)^2)^{\frac{1}{2}}$ | $l_2 = w \cdot l_0/z$ |
| $w = ((x_2 - a_2)^2 + (y_2 - b_2)^2)^{\frac{1}{2}}$ | $b = v \cdot l_0/z$ |

The angles $\gamma$ and $\lambda$ are found as follows:

$$\gamma = \tan^{-1}\left(\frac{y_2 - y_1}{x_2 - x_2}\right) - \tan^{-1}\left(\frac{-y_1}{-x_1}\right)$$

$$\lambda = \tan^{-1}\left(\frac{b_2 - b_1}{a_2 - a_1}\right) - \gamma$$

The angles are in the range $(-\pi,\pi)$ and the usual convention is used for $\tan^{-1}(c/d)$, i.e.:

If $c<0$ and $d<0$, $\tan^{-1}(c/d)$ is in the range $(-\pi, -\pi/2)$; If $c<0$ and $d>0$, $\tan^{-1}(c/d)$ is in the range $(-\pi/2,0)$; If $c>0$ and $d>0$, $\tan^{-1}(c/d)$ is in the range $(0,\pi/2)$; If $c>0$ and $d<0$, $\tan^{-1}(c/d)$ is in the range $(\pi/2,\pi)$ The inclination $\delta$ of the link $l_2$ is given by:

$$\delta = \tan^{-1}\left(\frac{b_2 - y_2}{a_2 - x_2}\right) - \gamma$$

The angle $\sigma$ defining the sign parameter S is the difference between $\lambda$ and $\delta$. It may occur, however, that $\lambda - \delta$ does not give the required angle between the link $l_2$ and the base link $b$. For example, if $\delta = -5\pi/6$ and $\lambda = 5\pi/6$ the expression $\delta - \lambda$ gives $-10\pi/6$, while the acute angle between $\lambda$ and $\delta$ is $\frac{1}{3}\pi$. In the range $-\pi<\lambda$ $\sigma<\pi$, $\sigma$ has the same sign as $\sin\sigma$ and this fact can be used to remove the uncertainty:

$\sin\sigma = \sin\delta \cdot \sin\lambda - \cos\delta \cdot \sin\lambda$

These sines and cosines may be expressed in terms of the given centre points and circle points. The sign parameter S is thus given by:

$$S = \frac{(b_2 - y_2)\cdot(b_2 - b_1) - (a_2 - x_2)\cdot(a_2 - a_1)}{|((b_2 - y_2)\cdot(b_2 - b_1) - (a_2 - x_2)\cdot(a_2 - a_1))|}$$

The value of parameter S, therefore, determines which of the two possible ways in which the linkage should be assembled. Then, in order to determine the particular, unique, coupler point corresponding to each input angle of the linkage, vector algebra is used, reference being now made to FIG. 6. The link vectors are denoted by Z0, Z1, Z2, Z3 and ZB, and each link vector has a constant magnitude: $l_0$, $l_1$, $l_2$, $l_3$ and $b$ respectively, FIG. 6. If $\theta_0, \theta_1, \ldots \theta_b$ respectively represent the directions of the vectors then for an input angle $\phi$:

$$\theta_0 = \phi$$

$$\theta_b = \lambda$$

The values of the other angles may now be calculated, but first it is necessary to define a further vector V with magnitude $v$ and with an angle $\theta_v$ representing the direction of V.

If V = ZB − ZO $$\xi = \cos^{-1}\left(\frac{v^2 + l_2^2 - l_1^2}{2 \cdot v \cdot l_2}\right)$$

The angle $\theta_2$ may be either $\theta_v + \xi$ or $\theta_v - \xi$. The sign parameter S determines which value of $\theta_2$ is correct:

Let:

$$t_1 = \sin(\theta_v + \xi)]\cos\lambda - \cos(\theta_v + \xi)\cdot\sin\lambda$$

$$t_2 = \sin(\theta_v - \xi)\cdot\cos\lambda - \cos(\theta_v + \xi)\cdot\sin\lambda$$

If $S \cdot t_1 > 0$, $\theta_2 = \theta_v + \xi$

If $S \cdot_2 > 0$, $\theta_2 = \theta_v - \xi$

It is then possible to find the value of Z1, and hence the co-ordinates $(x, y)$ of the coupler point:

$$Z1 = V - Z2$$

$$\theta_3 = \theta_4 + \delta$$

Let:

$$R = ZO + Z3$$

Then:

$$x = |R| \cos\theta_R + a_1$$

$$y = |R| \sin\theta_R + b_1$$

Tests are applied to the linkage which is derived by these means to determine whether it will generate a path, or orbit, which deviates by an acceptable amount, or less, from the idealized path. If the linkage is not suitable, i.e. the structural error is too large, then a different starting point must be defined by changing the selected precision points. The new precision points may be chosen, in accordance with a feature of the invention, by an optimisation method so that each relocation tends to a reduction of the structural error. Such process is repeated if necessary until a suitable linkage is derived or until it is evident that no linkage will be definable by these means which will generate an acceptable path or indeed if all the linkages defined by the starting points used have cognates which have a non-crank-and-rocker action.

The minimum error linkage found by this method may not be the best linkage for any practical application since the link lengths may be unsuitable or the linkage may have other undesirable properties. However, during this process of attempting to find a suitable linkage with the smallest acceptable structural error, a large number of intermediate linkages are synthesised and some of these may be considered to be more suitable than the minimum error linkage for certain practical applications, while still having an acceptably small structural error. The dimensions of all these intermediate linkages, together with their respective structural errors should be recorded so that the best for any particular requirement may be selected. One particular feature in making a choice may be a necessity for limitations to be placed on, say, the lengths of one or more of the links.

The procedure for relocating the precision points may be adapted to involve a random selection step, the precision points preferably being selected by a random number generator so that they have a uniform probability distribution in the interval 0 to 2 $\pi$ radians. Thus the selected points are selected in sets of five, each set being used to synthesize a linkage. The order in which the precision points should be labelled is not critical, so each set can be sorted into ascending order of magnitude to simplify the calculation of the structural error.

Since the process of selecting a set of five random precision points, sorting them and synthesising a linkage from them is equivalent to one relocation, the results obtained after a particular number of what might be called random relocations may be compared with the results obtained after the same number of relocations using the non-random methods and guidance may be obtained from such comparision as to the necessity for using the random selection methods.

Having derived the dimensions of an acceptable four-bar linkage to synthesise the required orbital path of the needles the Roberts-Chebychev theorem is invoked to derive the path-cognates. In FIG. 7 the synthesised linkage is shown in bold outline and the first and second cognate linkages in faint and broken outline respectively. The coupler point M is common to each linkage and the system of the three linkages may move as a whole so that the coupler point M will trace out the same path for each linkage. If the three linkages are separated and each generates its path at the same speed from similar starting points, corresponding links will have equal angular velocities and will remain inclined to each other at constant angles throughout the motion.

It will be evident that a single four-bar linkage of this kind will only move the needle in constant attitude over a short distance. However use is made of two of the linkages, either the synthesised linkage and one or other of the cognates or both cognates, to derive a further linkage which will constrain the needle to maintain its attitude at least throughout a substantial part of the whole orbital path.

Thus, taking linkages PCMDO and QBMAO in FIG. 7, these can be driven so that links PC and QB remain at the constant angle $\alpha$ to each other and the points M on each linkage will describe identical paths at the same time. By separating the two linkages while maintaining each similar pair of link members parallel to each other then a line joining the coupler points M on each linkage will move parallel to itself while the points M trace out identical paths. However, while such an arrangement would enable the needling operation in the Locstitch machine to be effectively carried out, it would involve preparation of an entire duplicate set of link members and difficulty would probably arise on account of the likelihood of serious interference between the linkages in motion. It is proposed that the linkages be combined in a combination linkage in a manner which may be that proposed by K. Hain ("Erzengung von Parallel - Koppelbewegungen mit Anwendungen in der Landtechnik" Grundlagen der Landtechnik 20, 1964, pp. 58 – 68).

Figure 8:
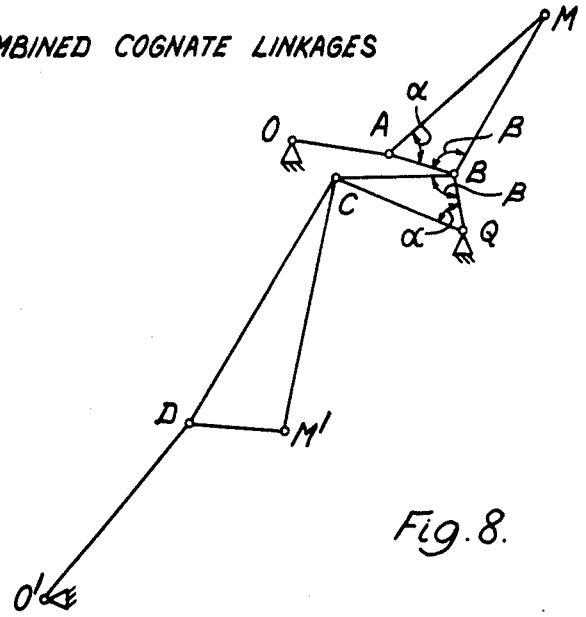
FIG. 8 shows the combination linkage.

Thus the linkage PCMDO may be arranged so that point P corresponds with the point Q of linkage QBMAO and the link members PC and QB arranged at the angle $\alpha$ to one another. If these two link members are then locked by joining BC with a rigid member, the motions of the two linkages will be such that a line between the two coupler points will move parallel to itself. By mounting a needle bar at these two coupler points, therefore, the correct needling motion can be achieved. Here, the necessity for duplication of the link members remains, although the mounting of the linkages has been simplified by the omission of one pivotal point. It will be observed, however, that the combination linkage shown in FIG. 8 has two redundant link members and by joining MM', as would be done to mount the needle bar, alternative six-bar linkages O'DM'CQBM and OAMBQCM', FIGS. 9*a* and 9*b*, may be derived by omitting the respective redundant link members.

Using a similar technique with another pair of the linkages in FIG. 7 it is possible to produce two further six-bar linkage systems; so that from the one four-bar linkage which is derived on the basis of the methods set out above, six cognate six-bar parallel motion linkages may be devised, all of which would generate the same path as the coupler point in the basic four-bar linkage. Practical use of any of the six six-bar systems would, however, depend upon the chosen pair of four-bar linkages having a crank-and-rocker action. This may be established by comparison of combinations of lengths of certain link members.

In the case of four-bar linkage OABMQ in FIG. 7, if this linkage has a crank-and-rocker action the link member HGM of linkage PGMHQ will make complete revolutions with QB and PC. In consequence, if the link member HGM were to be incorporated into a composite linkage to give parallel motion, the angle between HGM and link MM' would assume all values between 0° and 360° when the linkage was driven through a complete cycle. There would, therefore, be two positions in which the driven links MM' and HGM would be in a straight line in which event the subsequent motion would be unpredictable. It is clear, in that case, that the four-bar linkages of the cognates which include parts of link HGM are not suitable for use as needle actuating linkages since it is essential that the motion of the needles should be certain.

It may generally be assumed that if the synthesised four-bar linkage has a crank-and-rocker action, then two of the six original and cognate linkages are suitable for use in generating a parallel motion orbit while the other four are not suitable.

In accordance with a feature of the invention, in the paractical application of the parallel motion six-bar linkages shown in FIG. 9, a system of eccentrics may be used where the linkage movements required are small.

Figure 4:
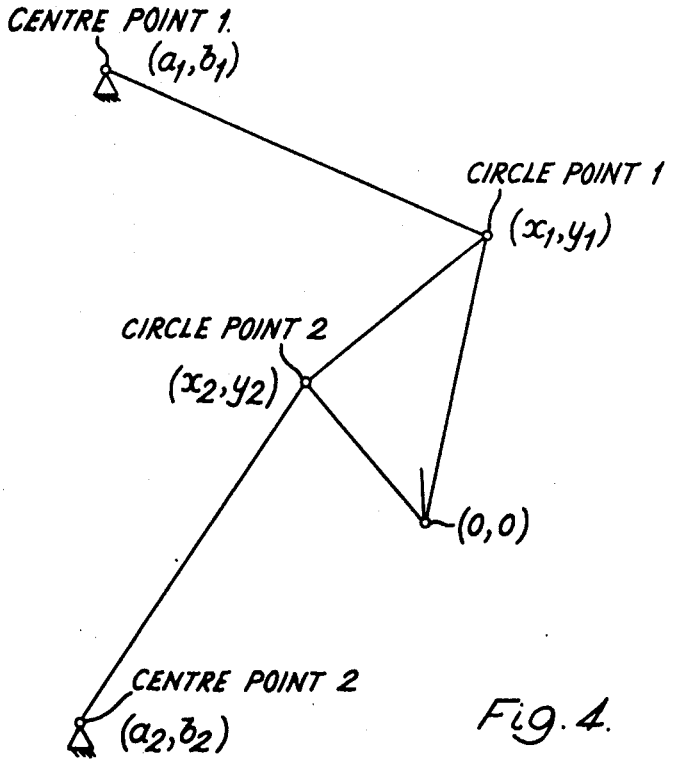
FIG. 4 shows a five-point linkage.

Thus for the linkage of FIG. 4 the co-ordinates of the two circle points ($x_1$, $y_1$) and ($x_2$, $y_2$) and of the corresponding centre points ($a_1$, $b_1$) and ($a_2$, $b_2$), in one particular example, are given in the following table (in mm.):

| | |
|---|---|
| $x_1 = 6.099$ | $a_1 = -5.580$ |
| $y_1 = 2.055$ | $b_1 = 14.302$ |
| $x_2 = -1.679$ | $a_2 = 65.193$ |
| $y_2 = 5.069$ | $b_2 = 97.725$ |

Figure 9A:
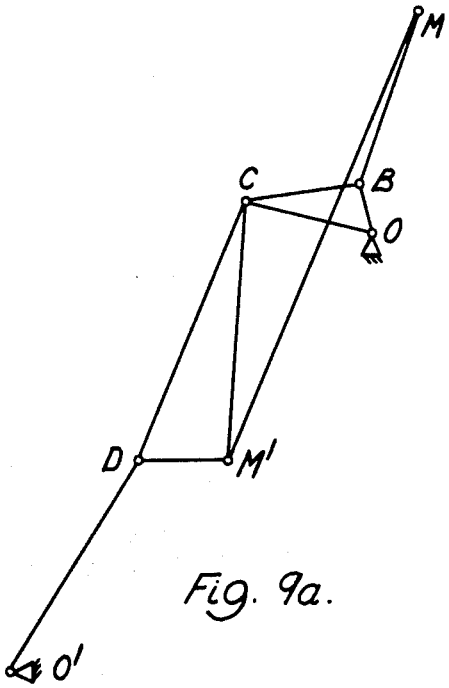
FIG. 9 shows another linkage.
Figure 9B:
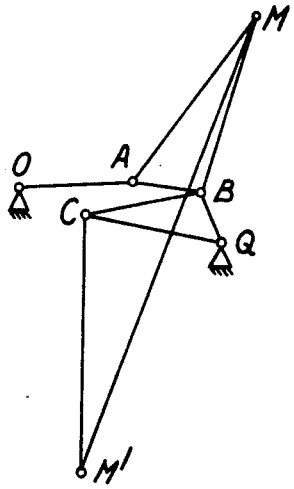
Figure 10:
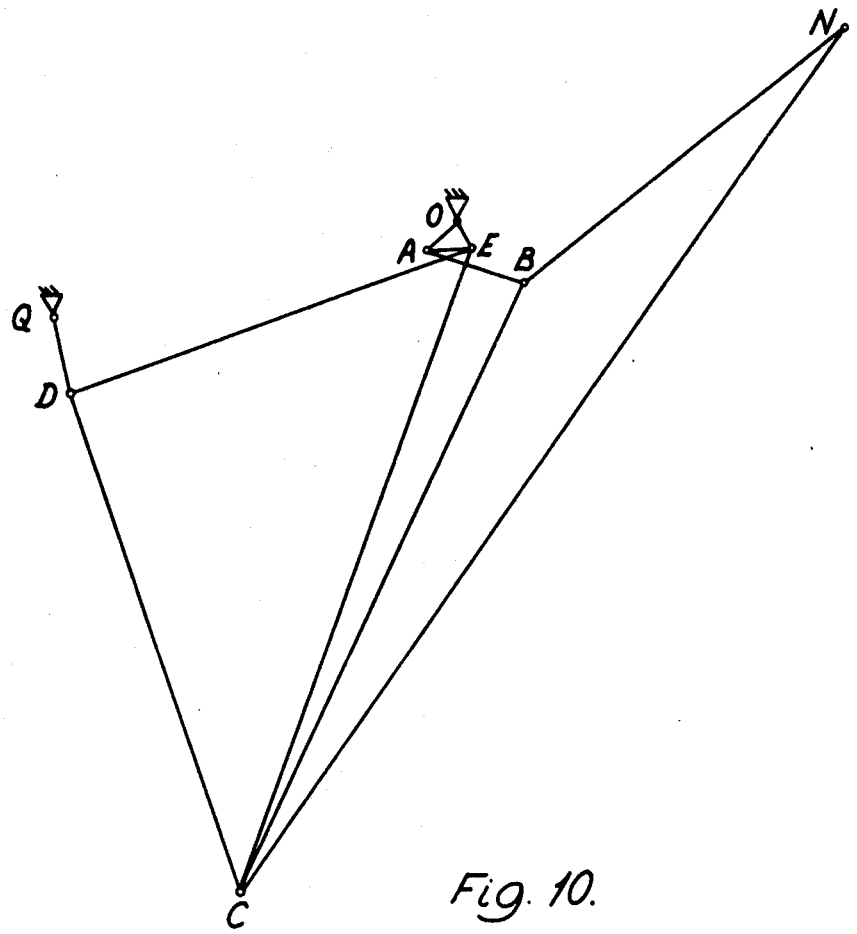
FIG. 10 shows a derived six-bar linkage.

From such co-ordinates, a synthesised four-bar linkage as shown in FIG. 5 can be established, making as point of origin, one of the points selected on the orbit to be generated by the output of the linkage. Using the technique illustrated in FIG. 7, the cognate linkages shown in FIG. 5 are then established. Again, using the technique illustrated in FIG. 8, a suitable arrangement of combined cognate linkages is derived, when a parallel motion linkage of a kind similar to that in FIG. 9*a* or 9*b* is established. Thus the linkage of FIG. 4 of the given definition, leads to the derivation of a six-bar parallel-motion linkage as shown in FIG. 10, wherein the link members are QD, DCE, EOA, AB, BCN and the base member QO is the frame of the machine. The needle movement is intended to be at the end N of the member BCN.

For the condition in which the needle is at the position of penetration of the fabric, the co-ordinates of the respective pivots are as follows:

| | |
|---|---|
| O : (0.0, 0.0) | A : (−6.33, −1.15) |
| B : (3.88, −14.64) | C : (−93.14, −70.14) |
| D : (−69.42, 14.77) | E : (0.93, −5.26) |
| N : (227.23, 6.97) | Q : (67.00, 25.33) |

Figure 11A:
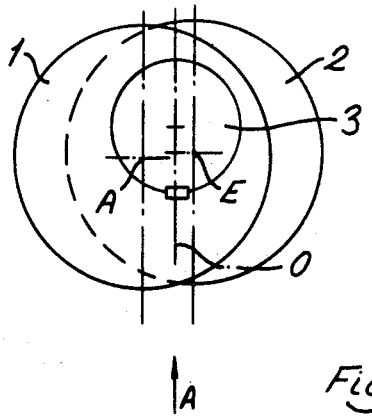
FIG. 11 shows eccentric pivots.
Figure 11B:
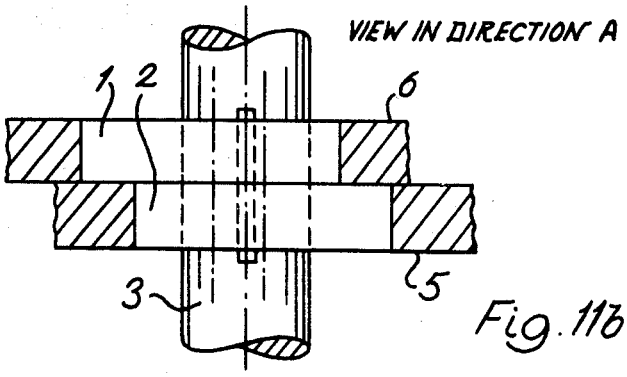

The small input link member OAE need not give rise to production difficulties if, in accordance with the feature of the invention, the pivots A and E are replaced by eccentrics, thus allowing the input shaft through pivot 0 to be continuously rotatable. As shown in FIG. 11 the pivot A is represented in eccentric 1 which replaces link OA, and the pivot E in eccentric 2 which replaces link OE, both of these eccentrics being keyed to the input shaft 3, the axis of which represents the base pivot 0. These eccentrics co-operate with flat sheet members 4 and 5 respectively representing link members BCN and CDE respectively and being in different planes interference between link members BCN and CDE is avoided.

Figure 12:
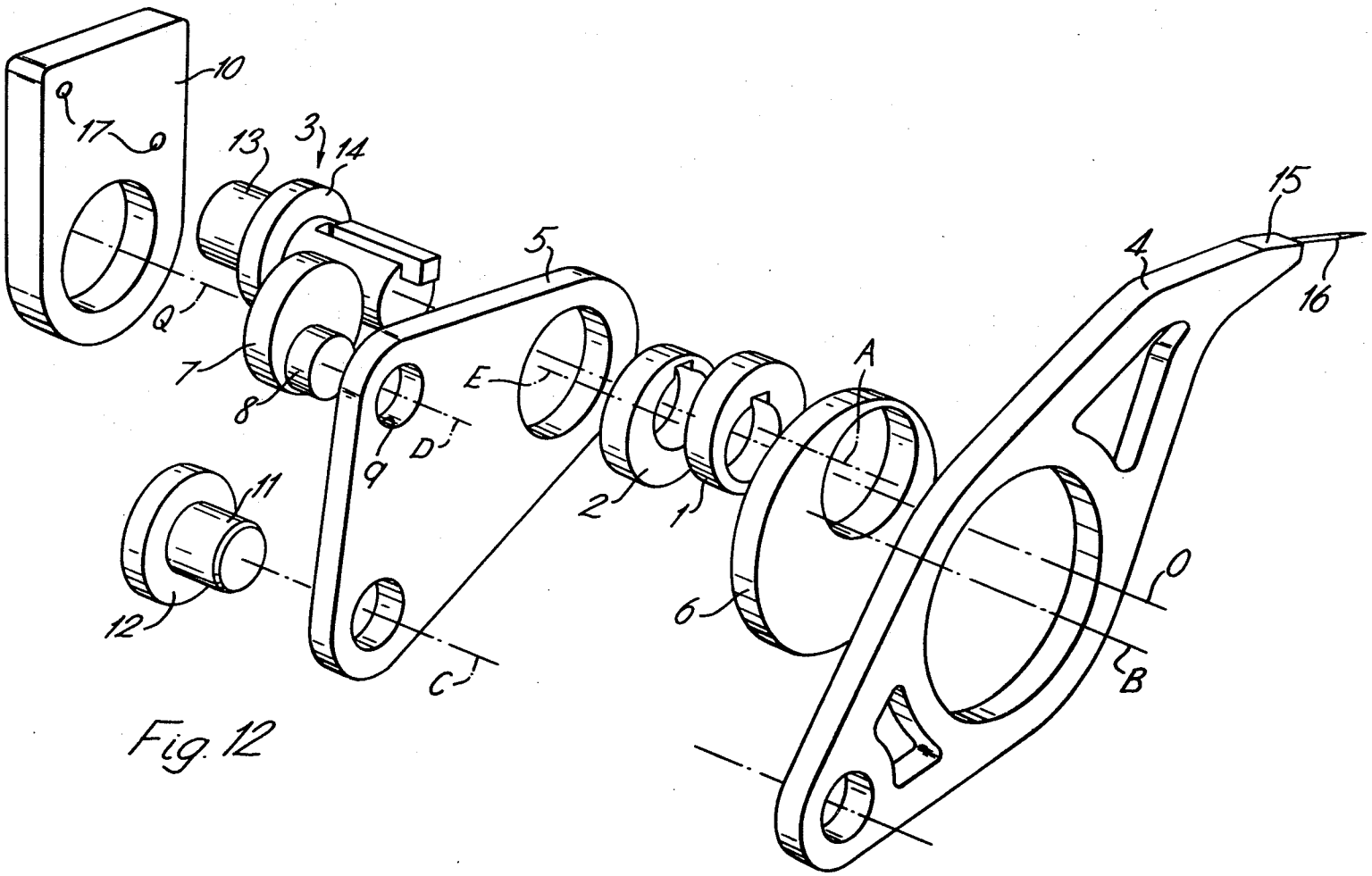
FIG. 12 shows a construction with a six-bar linkage.

In the construction illustrated in FIG. 12, link member AB is also represented by an eccentric, i.e. by the eccentric member 6 which is made a running fit on eccentric member 1 and also a running fit in a hole with centre B in the member 4 which represents the link member BCN. Eccentric 2 is a running fit in a hole with centre E in the member 5 which represents link member CDE. Member 5 has two further holes with centres representing pivots C and D respectively. The other link member QD is shown as the rocker element 7 which is a smooth running fit in a hole with centre representing base pivot Q in an anchor member 10, the off-centre boss 8 with centre representing pivot D being a smooth running fit in the hole 9 in member 5.

Members 4 and 5 are made smooth running fits on a boss 11 of a pivot member 12, the centre of this boss representing the pivot C.

Anchor member 10 may be mounted on a frame plate (not shown) through which the driving extension 13 of the shaft member 3 passes for coupling to a chain sprocket or other suitable driving device. By arranging for the thickness of the rocker element 7 to be slightly greater, say by 0.002 inch, than that of the anchor member 10 and for the thicknesses of the flange 14 of the shaft member 3 and the flange of pivot member 12 to be the same as that of the rocker element, the planes of the members 4 and 5 may be maintained substantially parallel to each other and to that of the frame mount to permit of smooth operation.

Member 4 is shaped at point N to carry a needle bar 15 on which needles 16 are to be fixed. In operation, a number, at least two, of the members 4 will be arranged along the length, or one at each end, of a needle bar and a plurality of needle bars with their mountings may be arranged in line across the width of the machine. It will be appreciated that, except at the point N of the member 4, the actual profile of both members 4 and 5 may be of any shape so long as they embrace the co-operating members.

This assembly could replace the standard cam-operated mechanism for the known Locstitch machine and would co-operate with the loopers in that machine. A second set of needle actuating linkages would be provided in such a machine to co-operate with the loopers on the opposite side of the fabric plane to enable pile loops to be produced on one or other of or both the sides of the fabric in known manner.

The choice of materials for the various members and elements of the arrangement described will be apparent to meet the particular circumstances surrounding the use of the apparatus.

It will be understood, of course, that the invention is applicable to any situation where a movable member is required to move through a closed-loop path while maintaining the movable member in fixed attitude relative to a given plane in space. It will be seen that a linkage mechanism in accordance with a feature of the invention may be manufactured by comparatively simple methods and that, by suitable choice of relative dimensions, it is possible to make use of standard ball or roller bearings and thereby even to avoid the necessity for any close machining tolerance, making use of machine setting facilities to position the various centres relative to one another.

According to a further feature of the invention, arrangements may be made in a linkage for actuating a reciprocating operating member, for controlling the width of the path followed by the operating member. Thus, in the case of a stitching machine, such as the Locstitch machine above referred to, arrangements may be made comparatively simply to control the length of stitch. Referring to FIG. 10, the linkage can be adjusted by moving one or more of the pivots O, A, B, C, D, E and Q, thereby altering the dimension of at least one link. Of course, adjustments in which only one pivot is moved are preferred since they are comparatively simple to make, particularly if the pivot Q, which does not normally move during the needle orbit, is chosen — that results in adjustment of the length of only the frame link OQ. To enable pivot Q to be adjusted this pivot can be mounted on a link which can be fixed in different positions and such an arrangement is illustrated in FIG. 12.

In FIG. 12, the anchor plate 10 is provided with fixing holes 17 and bolts (not shown) for fixing the plate 10 to the frame of the machine are passed through slots or other loose fitting holes, to provide a certain amount of freedom of movement before the bolts and anchor plate are fixed in the desired clamped position on the frame. The arrangement of FIG. 12 may be useful for empirical adjustment, watch being kept on the needle orbit relative to the fabric position; however, it appears that adjustments of extremely small proportions may lead to a whole range of stitch pitchings with a particular basic linkage and it will probably be desirable to provide some kind of vernier adjustment in place of the rather crude arrangement of FIG. 12. In any event, it appears to be possible to arrange for adjustment without stopping the machine for the purpose.

Since, in effect, the adjustment of only one pivot will cause a small deviation from parallel motion because the length of only one link will be changed, it is advantageous that extremely small changes may be required. The needle can be expected therefore to experience small variations of angle during operation for some at least of the settings. For design purposes, it is assumed that the needle will pass through a common point of penetration in the plane of the fabric and in order to find which positions of pivot Q will produce needle orbits passing through the fixed point N in FIG. 10 it is observed that the linkage OAECBN, which is a kinematic chain, has five links, namely OAE, AB, CE, BCN and ON and six joints, O, A, B, C, E and N, N being treated as though it is a point on the frame. Hence, using the mobility criterion described by Hartenberg and Denavit (Kinematic Synthesis of Linkages, McGraw-Hill, 1964, pp. 134 - 137) the degrees of freedom F of the kinematic chain is:

$F = 3 \times (5 - 1) - 2 \times 6$, which equals zero.

This chain, OAECBN, is not, therefore, movable. The link CE and hence the pivot D, can not move and the only possible locus of the pivot Q is, therefore, a circle with centre D and radius DQ. The adjusted positions of the point Q which give rise to orbits which pass trough the point N, lie on this circle.

Typical variations of stitch lengths obtained by adjustment of the position of pivot Q are shown in the following table.

| Co-ordinates of pivot Q | | Number of stiches |
|---|---|---|
| x | y | per meter |
| −67.00 | 25.33 | 376 |
| −67.25 | 25.38 | 321 |
| −67.76 | 25.47 | 262 |

In making adjustments to the position of point Q care has to be taken that the motion of the needle point N is such as still to give a suitable orbit which will be correctly related to the orbit of the second needle in the Locstitch machine and also that these orbits are suitable to co-operate correctly with the loopers of the machine. In designing the linkages these points may be determined by calculation.

We claim:

1. Means for effecting movement of an object in a closed loop planar path comprising a six-bar linkage mechanism the dimensions of the link members of which are derived from a four-bar linkage and a second linkage cognate with said four-bar linkage, said four-bar linkage being dimensioned to generate a path passing through at least selected precision points, on an idealized version of said closed loop path, said six-bar linkage mechanism including a link member which maintains a substantially fixed attitude relative to a given plane in space during execution of at least an appreciable portion of the path, said object forming at least part of or being mounted on said link member for movement therewith.

2. A method of designing a linkage mechanism for effecting movement of an object in a closed loop planar path while maintaining the major axis of the object in substantially fixed attitude in the execution of at least an appreciable portion of the path, comprising selecting a set of a finite number of discrete precision points, around an idealised version of the said closed loop path, establishing the dimensions of a four-bar linkage which will generate a synthesized path passing through the said selected precision points and deriving from said four-bar linkage the dimensions of a six-bar linkage which will cause the required fixed attitude motion in the synthesized path.

3. The method as claimed in claim 2, wherein the said selected precision points are chosen to yield a path of motion which deviates from said idealized path by only an acceptable amount.

4. The method as claimed in claim 3, wherein the choice of precision points is arrived at by a series of relocation of selected precision points and evaluating the resulting linkages.

5. The method as claimed in claim 2, wherein the minimum choice of precision points is five.

6. The method as claimed in claim 2, wherein said precision points are selected by an optimisation process to provide a successive reduction of structural error.

7. The method as claimed in claim 2, wherein the Roberts-Chebychev Theorem, as hereinbefore identified, is used to establish two cognate four-bar linkages from which the six-bar linkage is derived.

8. The method as claimed in claim 7, wherein a pair of cognate linkages is spaced and orientated relative to one another and linked to provided the six-bar linkage.

9. Means in accordance with claim 1, for effecting movement of an object in a closed loop planar path while maintaining the object in substantially fixed attitude during execution of at least an appreciable portion of the path, wherein at least one of the link bars in the derived six-bar linkage is constituted by at least one eccentric device.

10. Means in accordance with claim 9, wherein said eccentric device is constituted by a disc member with a circular hole off-centre of the disc and mating with a second link bar.

11. Means in accordance with claim 10, wherein said second link bar is also constituted by an eccentric device in the form of a second disc member having a circular hole off-centre of said second disc member and fixed to a drive shaft.

12. Means in accordance with claim 11, wherein said drive shaft is keyed into an off-centre hole in at least one further disc member which mates with a hole in yet another, pivoted, link bar.

13. Means for effecting movement of an object in a closed loop planar path while maintaining the major axis of the object in substantially fixed attitude in the execution of at least an appreciable portion of the path, comprising a six-bar linkage mechanism the dimensions of the members of which are derived from a four-bar linkage and cognate linkage to ensure said fixed attitude motion of said object during said portion at least of the said path, said four-bar linkage being dimensioned to generate a path passing through at least selected precision points, as hereinbefore defined, on an idealized version of said closed loop path, wherein the derived six-bar linkage comprises first and second planar members pivoted to each other, the said object being associated with said first planar member at a point spaced from the pivotal axis, said first planar member having a circular hole therein, the center of which is spaced from said pivotal axis by a distance equivalent to one of the link bars, a disc member rotatably mating with said first hole and having a circular hole therein with centre which is offset from the centre of said first disc member by a distance equivalent to a second link bar, a second disc member rotatably mating with said hole in the first disc member and having a hole with centre offset from the centre of said second disc member, a drive shaft for the six-bar linkage, said shaft being fitted concentrically within said hole in said second disc member and being fixed rigidly thereto, a third disc member having a hole therein with centre offset from its centre within which said shaft is concentrically fitted, said third disc member being rigidly fixed to said shaft, the magnitudes of said two offsets and the relative angular disposition of the directions of these offsets in said second and third members being equivalent to a third link bar, said third disc member rotatably mating with a circular hole in said second planar member and said second planar member being pivoted to a second pivotal point, the relative disposition of the centre of said hole in said second planar member and the two said pivotal points therein being equivalent to a fourth link bar, and a pivot providing said second pivotal point and being mounted on a fourth disc member, the axis of the said pivot being offset from the centre of said fourth disc member by a distance equivalent to a fifth link bar of the linkage, the axes of all said disc members and said pivotal axes being parallel to each other and to the axis of rotation of said shaft, said fourth disc member being rotatable about its central axis but having its axis restrained at a distance from said shaft axis equivalent to the sixth link bar of the linkage.

14. Means in accordance with claim 13, wherein said fourth disc member rotatably mates with a circular hole in an anchor member.

15. Means in accordance with claim 14, wherein mounting means is provided for said anchor member, said mounting means being adjustable whereby the said second pivotal axis and the axis of said shaft may be set in different relative dispositions.

* * * * *